US005208417A

United States Patent [19]

Langer et al.

[11] Patent Number: 5,208,417

[45] Date of Patent: May 4, 1993

[54] METHOD AND SYSTEM FOR AIMING A SMALL CALIBER WEAPON

[75] Inventors: Moshe Langer, Nes-Ziona; Zion Azar, Nave Monoson; Uriel Halavee, Ramat-Gan, all of Israel

[73] Assignee: The State of Israel, Atomic Energy Commission, Soreq Nuclear Research Center, Yavne, Israel

[21] Appl. No.: 812,703

[22] Filed: Dec. 23, 1991

[30] Foreign Application Priority Data

Jan. 2, 1991 [IL] Israel ..... 96869

[51] Int. Cl.[5] ..... F41G 1/36

[52] U.S. Cl. ..... 89/41.06; 356/152; 340/705; 362/110

[58] Field of Search ..... 42/103; 89/41.06, 41.17, 89/41.21; 244/3.11; 340/705; 356/152; 359/13, 14, 630; 362/110, 111, 112, 113, 114

[56] References Cited

U.S. PATENT DOCUMENTS

| | | | |
|---|---|---|---|
| 3,699,345 | 10/1972 | Parkin | 356/141 |
| 3,941,483 | 3/1976 | Ferrin | 356/152 |
| 4,244,131 | 1/1981 | Kaelin | 42/103 |
| 5,035,474 | 7/1991 | Moss et al. | 356/152 |
| 5,064,988 | 11/1991 | E'nama | 42/103 |

OTHER PUBLICATIONS

Army Research and Development News Magazine, p. 8 and illustration, Nov.-Dec. 1974.

"Sighting Systems for Small Arms" by Steadman, International Defense Review, Sep. 1989.

"The Advanced Combat Rifle Programme" by Jacques Lenaerts, Military Technology Miltech, Oct. 1989.

"Long-Range I.R. Laser-Aiming Light" AIM-1DLR, International Technologies (Lasers) Ltd.

*Primary Examiner*—Stephen C. Bentley

*Attorney, Agent, or Firm*—Helfgott & Karas

[57] ABSTRACT

A method and system for aiming a small caliber weapon at a target wherein a light beam is directed from the weapon towards an area of the target so as to form a light spot on an object in the target area and the light spot is imaged on a two-dimensional detector so as to form an image thereon whose displacement from an origin of the detector bears a predetermined relationship to a corresponding displacement of the object from a center of the target. The image of the light spot is projected on to a visor worn by a marksman having a reference mark thereon for visually determining the center of the target, and the cycle is repeated as required until the projected image of the light spot on the visor is coincident with the reference mark.

12 Claims, 5 Drawing Sheets

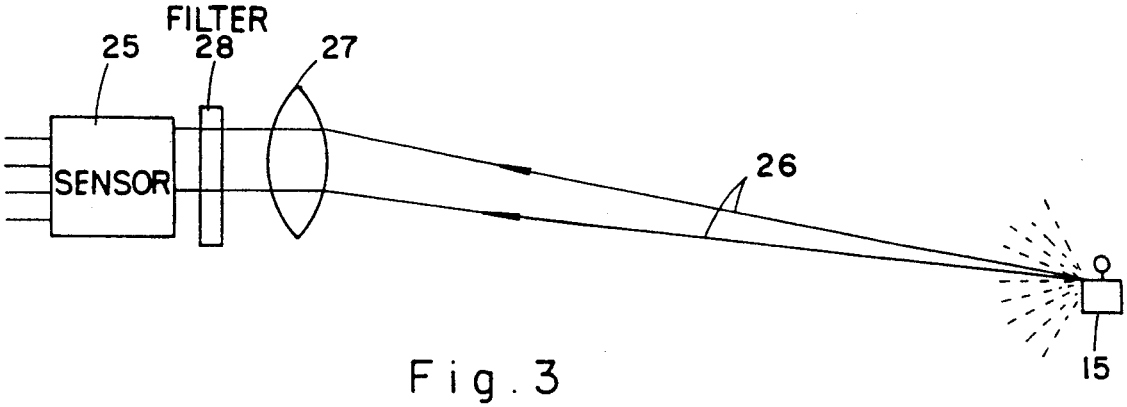
Fig. 3
Fig. 4
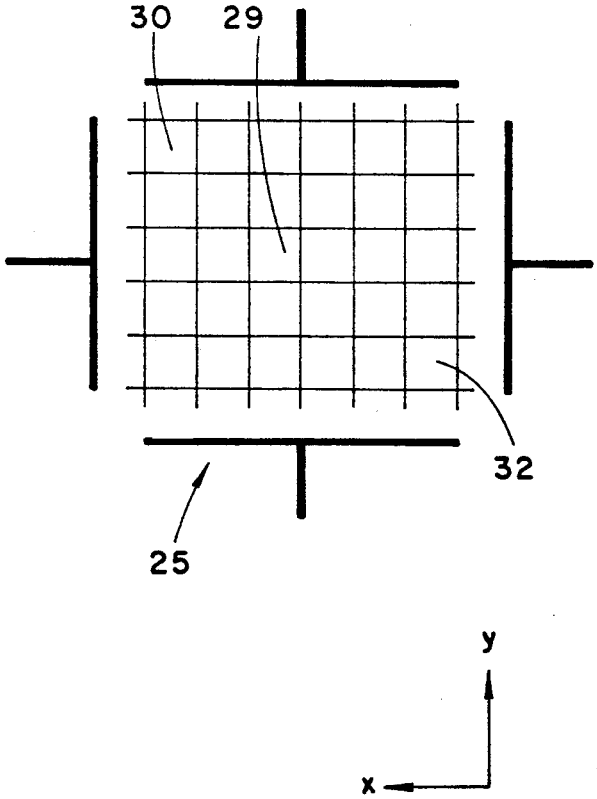

METHOD AND SYSTEM FOR AIMING A SMALL CALIBER WEAPON

FIELD OF THE INVENTION

This invention is related to a method and system for aiming a small caliber weapon. In particular, it relates to such a method and system for use while the marksman is in motion.

BACKGROUND OF THE INVENTION

Traditionally, there are two methods for aiming a small caliber weapon while the operator is in motion: instinctive aiming from the hip and holding the weapon at eye level whilst sighting the target parallel to the gun barrel. Both methods have their drawbacks: the first is extremely inaccurate whilst the second requires that the marksman remains stationary during the aiming process, during which time he is vulnerable to enemy fire. Even then, conventional weapon sights are not accurate enough and there exist several prior art proposals for improving their accuracy.

Some methods for improving conventional weapon sights include mounting a laser emitter on the weapon and using it as an aim-point designator in training and operational conditions. However, if the laser light is in the visible range, the marksman exposes himself, whilst if it is invisible, an interface is required to render the laser spot visible. The interface is usually constituted by a pair of night vision goggles having a narrow field of view. In such devices the marksman sees the spot on a screen superimposed on an image of the target area included in a narrow field of view. The main drawbacks of such prior art systems are that the view is two-dimensional and therefore lacks perspective and that, since the field of view is narrow, the weapon has to be aimed accurately within the target area in order to see the target and the spot together on the screen. Preferably, a weapon aiming device would permit the marksman to view the spot, superimposed on the scene, so that he will be able to aim and shoot without taking his eye off the target. Such comprehensive devices do not presently exist in the field.

Various approaches have been suggested for improved weapon aiming systems. U.S. Pat. No. 4,177,580 (Marshall et al.) discloses a target system which is responsive to and indicative of the hits and areas of near miss of laser light pulses shot from a laser weapon aimed at the target system by a marksman. In the system proposed by Marshall et al., pulling the trigger directs a pulse of laser light towards a target having an array of light sensitive cells thereon. The light sensitive cells are responsive to the laser light pulses for indicating to the marksman where he "hits" the target and data processing means are included for indicating to the marksman his accuracy relative to a bullseye.

Clearly, such a system is effective for improving a marksman's aim but is not amenable to operational use in the field.

U.S. Pat. No. 4,553,943 (Ahola et al.) also proposes a system directed to an optical method for shooting practice. Again, a beam of light is directed towards a target on squeezing the trigger and the target is provided with light-sensitive elements thereon for generating an electrical signal. In particular, the light-sensitive elements receive continuous information from the weapon subsequent to its firing, thereby permitting the movement of the weapon during aiming and discharge to be analyzed and for the results to be recorded.

U.S. Pat. No. 4,577,962 (de Guillenschmidt et al.) discloses a method and system for aiming and firing a weapon at a real target, there being associated with the weapon a laser radiation source and detector mounted in close proximity to the weapon. The system includes a laser source whose orientation can be adjusted independently of the weapon-pointing operation, thereby permitting continuous detection of the radiation by the detector upon reflection from the target. Means are provided for maintaining the beam automatically oriented on the target regardless of target displacement, thereby permitting the location of the target relative to the marksman to be determined by triangulation. Such a system is of particular application for ballistic projectiles and guided missiles but is not applicable to small caliber firearms.

SUMMARY OF THE INVENTION

It is an object of the invention to provide a method and system for aiming a small caliber firearm at a target, in which the drawback associated with hitherto proposed methods and systems are substantially eliminated or reduced.

According to a first aspect of the invention there is provided a method for aiming a small caliber weapon at a target, comprising the steps of:

(a) directing a light beam from the weapon towards an area of the target so as to form a light spot on an object in the target area, (b) imaging the light spot on a two-dimensional detector so as to form an image thereon whose displacement from an origin of the detector bears a predetermined relationship to a corresponding displacement of said object from a center of the target, (c) projecting the image of the light spot on to a visor worn by a marksman having a reference mark thereon for visually determining the center of the target, and (d) repeating steps (a), (b) and (c) as required until the projected image of the light spot on the visor is coincident with the reference mark.

According to a second aspect of the invention there is provided a system for aiming a small caliber weapon at a target, the system comprising:

a light source fixed to the weapon for directing a beam of light in a direction substantially parallel to a barrel of the weapon so as to be reflected by an object in an area of the target as a reflected beam, a visor worn by a marksman having a reference mark thereon for determining a line of sight along which the weapon must be aimed, sensor means mounted in a fixed relationship relative to the visor for receiving the reflected beam and producing an image thereof, and superimposing means for superimposing the image on to the visor such that the superimposed image lies on said line of sight when the weapon is aimed towards a center of the target.

Preferably, the light beam is derived from a laser source operating in the invisible range of the spectrum and the sensor is a two-dimensional position sensitive device operating in the same range of the spectrum as the laser.

Optical means are provided for projecting the spot image of the laser beam on to the visor within the field of view of the marksman via substantially parallel rays of light so that the spot image appears to originate from infinity. In this manner, the marksman sees the image of the laser spot whilst focusing on the distant target, the sensor being calibrated such that when the superimposed image is coincident with the center of the target as seen by the marksman, the weapon is correctly aimed.

Such a system provides a high degree of marksmanship, requiring no physical connection between the weapon and the visor or sensor, so that the marksman is free to move the weapon in any direction and does not need to remain stationary whilst aiming.

BRIEF DESCRIPTION OF THE DRAWINGS

For a clearer understanding of the invention and to appreciate how the same may be carried out in practice, a preferred embodiment will now be described, by way of non-limiting example only, with reference to the accompanying drawings in which:

FIG. 3 is a schematic representation showing an optical system for use with the arrangement shown in FIG. 1 in order to direct the reflected laser beam as a spot onto the detector;

FIG. 4 shows schematically a two-dimensional sensor for use with the system illustrated in FIG. 1;

DETAILED DESCRIPTION OF A PREFERRED EMBODIMENT

Figure 1A:
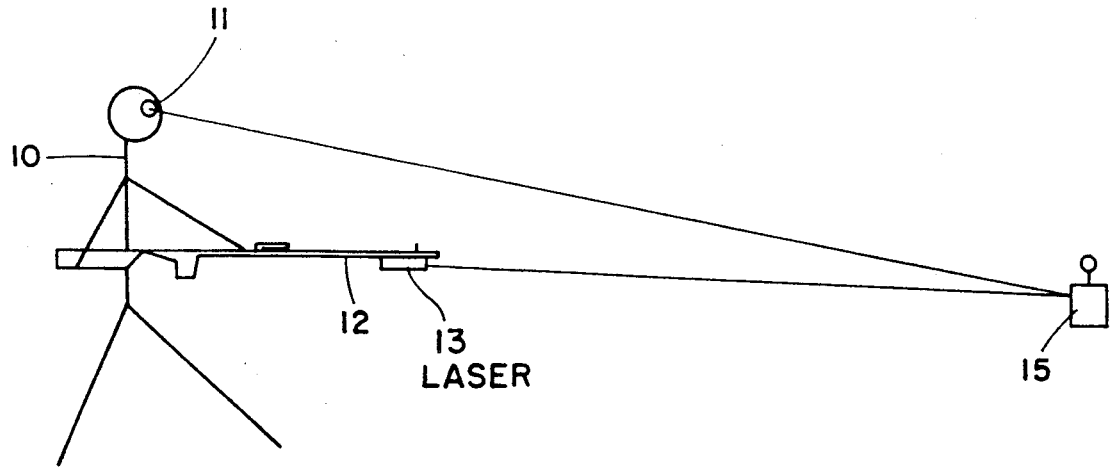
FIGS. 1*a* and 1*b* are pictorial representations showing schematically a marksman aiming a rifle at the center of a target and off target, respectively.
Figure 1B:
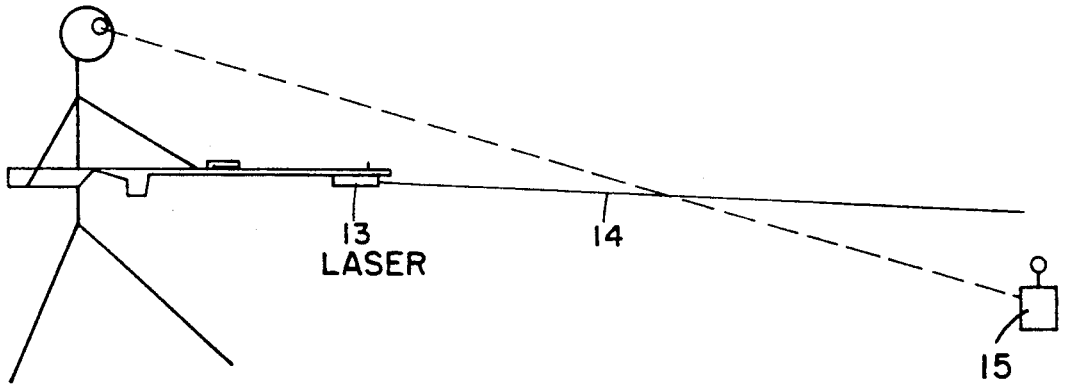

Referring to FIGS. 1*a* and 1*b* there is shown a marksman 10 wearing a visor 11 and holding a rifle 12. Mounted on the rifle 12 is a laser 13 (constituting a light source) for directing a beam 14 of laser light towards a target 15 in a direction substantially parallel to the barrel of the rifle 12.

On striking the target 15, the beam 14 is diffused and forms a spot on the surface of the target 15. A sensor (not shown) is associated with the visor 11 for receiving a reflected image of the spot formed by the laser beam 14 on the target 15.

In the arrangement shown in FIGS. 1*a* and 1*b*, the target 15 is assumed to be located a large distance from the marksman 10 relative to the displacement between the sensor and the rifle 12. Thus, from the perspective of the target 15, the laser 13 and the sensor associated with the visor 11 are substantially coincident. Consequently, if the sensor and the laser beam 14 are directed at the same point, the reflected image of the spot will appear at the center of the sensor. Alternatively, if the laser beam is directed off center, for example down and to the right of the aim point, and the sensir is aimed at the center of the target 15, the reflected image of the spot will appear up and to the left of the center of the sensor.

Figure 2A:
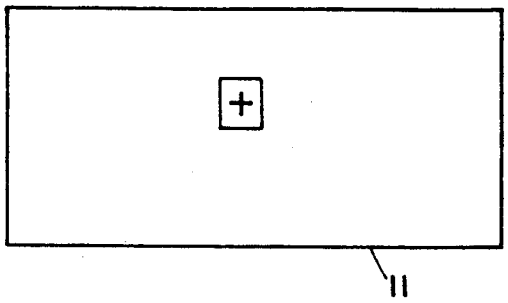
FIGS. 2*a* and 2*b* are pictorial representations of a visor for use with the invention for displaying information relating to FIGS. 1*a*, 1*b*, respectively.
Figure 2B:
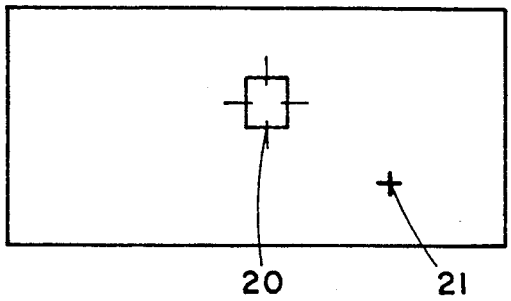

FIGS. 2*a* and 2*b* relate to the situations shown in FIGS. 1*a* and 1*b*, respectively, and show the visor 11 having at the center thereof a cross 20 which the marksman directs at the aim point of the target 15. Thus, through the visor 11, the marksman 10 views the target 15 aligned with the cross 20. When the laser beam 14 is triggered, the laser spot is reflected to the sensor and superimposed electronically on the visor 11 as a superimposed image 21 so that the marksman is able to assess what correction he has to make in order that the cross 20 and the superimposed image 21 will coincide.

Thus, FIG. 2*a* shows the situation where the superimposed image 21 and the cross 20 coincide indicating that the rifle 12 is aimed at the center of the target 15. FIG. 2*b* shows the situation corresponding to FIG. 1*b*, wherein the marksman 10 has aimed down and to the right of the aim point, such that the superimposed image 21 is down and to the right of the cross 20.

Referring to FIG. 3 there are shown the principal optical elements associated with a two-dimensional position sensitive sensor which produces two output signals proportional to the displacement of the horizontal and vertical co-ordinates of the laser spot relative to the center of the sensor (constituting a predetermined origin). The laser beam 14 (FIG. 1) is reflected by the target 15 as a reflected beam 26 which is focused by a lens 27 and directed to the sensor 25 via an optical band pass filter 28. The filter 28 allows only the wavelength of the laser 13 to pass and blocks the rest of the spectrum.

FIG. 4 shows schematically the sensor 25 in more detail. The sensor comprises a plurality of pixels, a respective one of which is illuminated by the spot image of the laser beam falling on the target 15. When a central pixel 29 of the sensor 25 is illuminated by the spot image the magnitude of the two signals representing the horizontal and vertical displacements of the central pixel 29 relative to a Cartesian x-y frame shown in the Figure and denoted, respectively, by $V_{H0}$ and $V_{V0}$ are both zero, irrespective of the illumination intensity.

When a pixel denoted by 30 whose x- and y-displacements are both positive with respect to the central pixel 29, the respective magnitudes of the horizontal and vertical signals are $V_{H0}+\delta H$ and $V_{V0}+\delta V$, again irrespective of the illumination intensity. Likewise, at a pixel 32 whose x- and y-displacements relative to the central pixel 29 are both negative, the respective magnitudes of the horizontal and vertical signals are $V_{HO}-\delta H$ and $V_{VO}-\delta V$.

Figure 5:
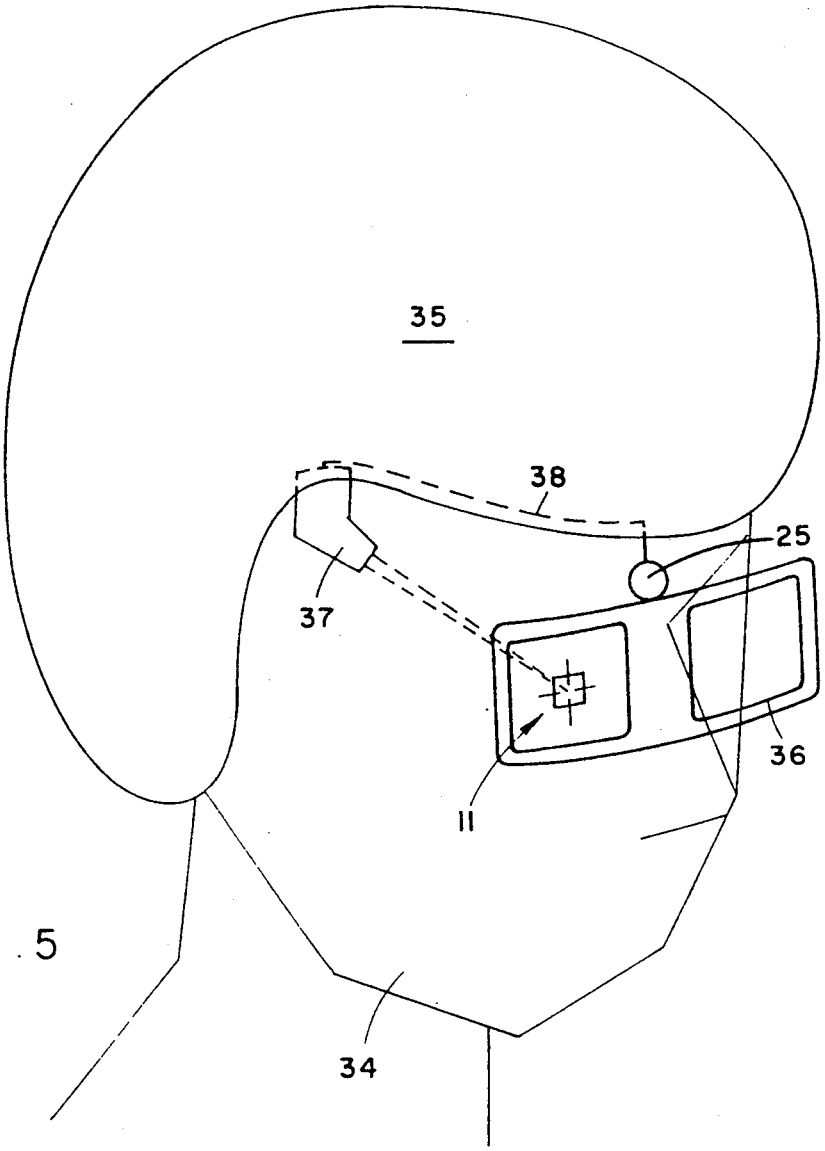
FIG. 5 is a pictorial representation of a visor and optical system for use by the marksman shown in FIG. 1 and having the sensor fixed thereto.

FIG. 5 shows pictorially a marksman 34 wearing a helmet 35 with the visor 11 and having mounted thereon the sensor 25. A superimposing means designated generally as 37 is fixed to the helmet 35 and is electrically connected to the sensor 25 by means of an electrical connection 38.

The sensor 25 has a continuous photo-sensitive surface for producing a continuously variable output depending on where the reflected beam 14 (FIG. 1) strikes the surface of the sensor 25. The sensor 25 produces two signals corresponding to the respective x- and y-displacements of the image from the origin 29 of the sensor 25. The signals are conducted via the electrical connection 38 to the superimposing means 37 for superimposing an image of the reflected beam on to the visor 11, in the correct spatial relationship relative to the cross 20.

Figure 6:
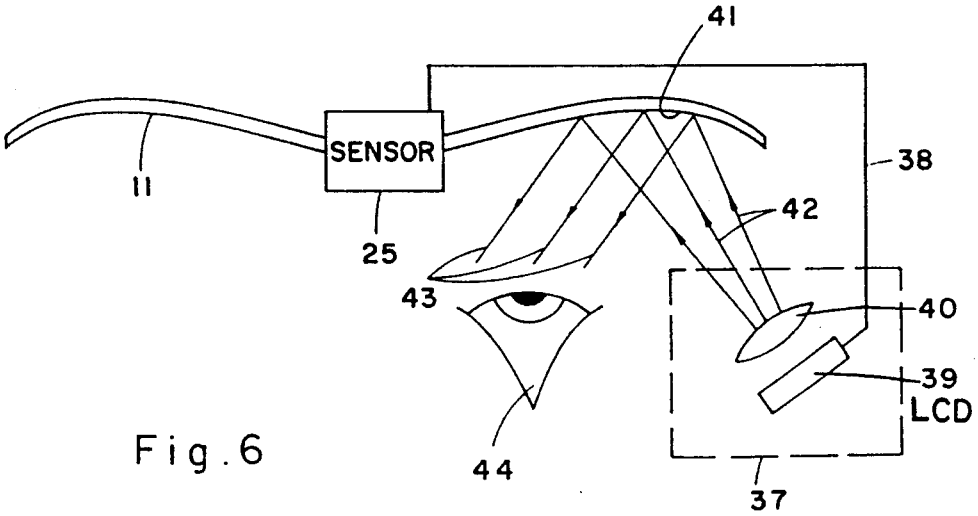
FIG. 6 is a detail of the visor and optical system shown in FIG. 5.

FIG. 6 shows a detail of the superimposing means 37 shown in FIG. 5. The superimposing means 37 includes a two-dimensional light emitting array such as a liquid crystal display (LCD) 39 having a plurality of pixels. The LCD 39 is connected to the sensor 25 by means of the electrical connection 38 and is responsive to the two electrical signals produced by the sensor 25 for illuminating one of the pixels of the LCD 39.

An optical means 40 images the illuminated pixel on to the visor 11 having an inner surface 41 formed of a partially reflecting material. Thus, rays of light 42 projected by the optical means 40 strike the partially reflecting surface 41 of the visor 11 so as to be reflected thereby as substantially parallel rays of light 43. An eye 44 of the marksman 34 seeing the parallel rays of light 43 interprets the reflected image of the illuminated pixel as though it originates from infinity.

By this means both the target 15 (FIG. 1) and the reflected image of the laser spot are seen by the marksman 34 at the same time, both in focus.

Figure 7:
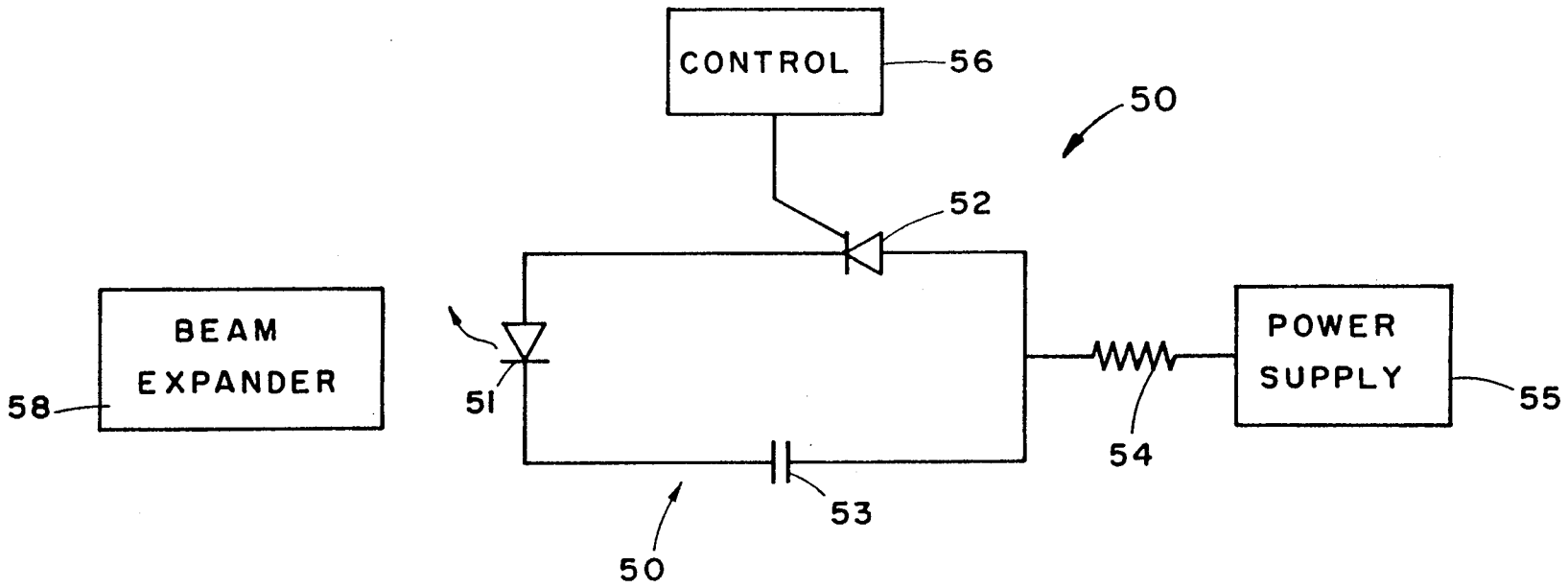
FIG. 7 shows schematically a circuit diagram of a laser driver for use in the system shown in FIG. 1.

FIG. 7 is a circuit diagram showing the principal components of a laser driver 50 for use with the laser 13 shown in FIG. 1. The laser is constituted by a laser diode 51 whose anode is connected to the cathode of a thyristor 52 and whose cathode is connected to one terminal of a capacitor 53. The anode of the thyristor 52 and the other terminal of the capacitor 53 are connected via a resistor 54 to a power supply 55. The gate of the thyristor 52 is connected to a control circuit 56 which permits the thyristor 52 to conduct every time a gate pulse is applied. In this manner, the laser diode 51 emits light at a pulse rate determined by the control circuit 56 and typically having a frequency of several kilohertz. Associated with the laser diode 51 is a beam expander 58 for expanding the laser beam.

Figure 8:
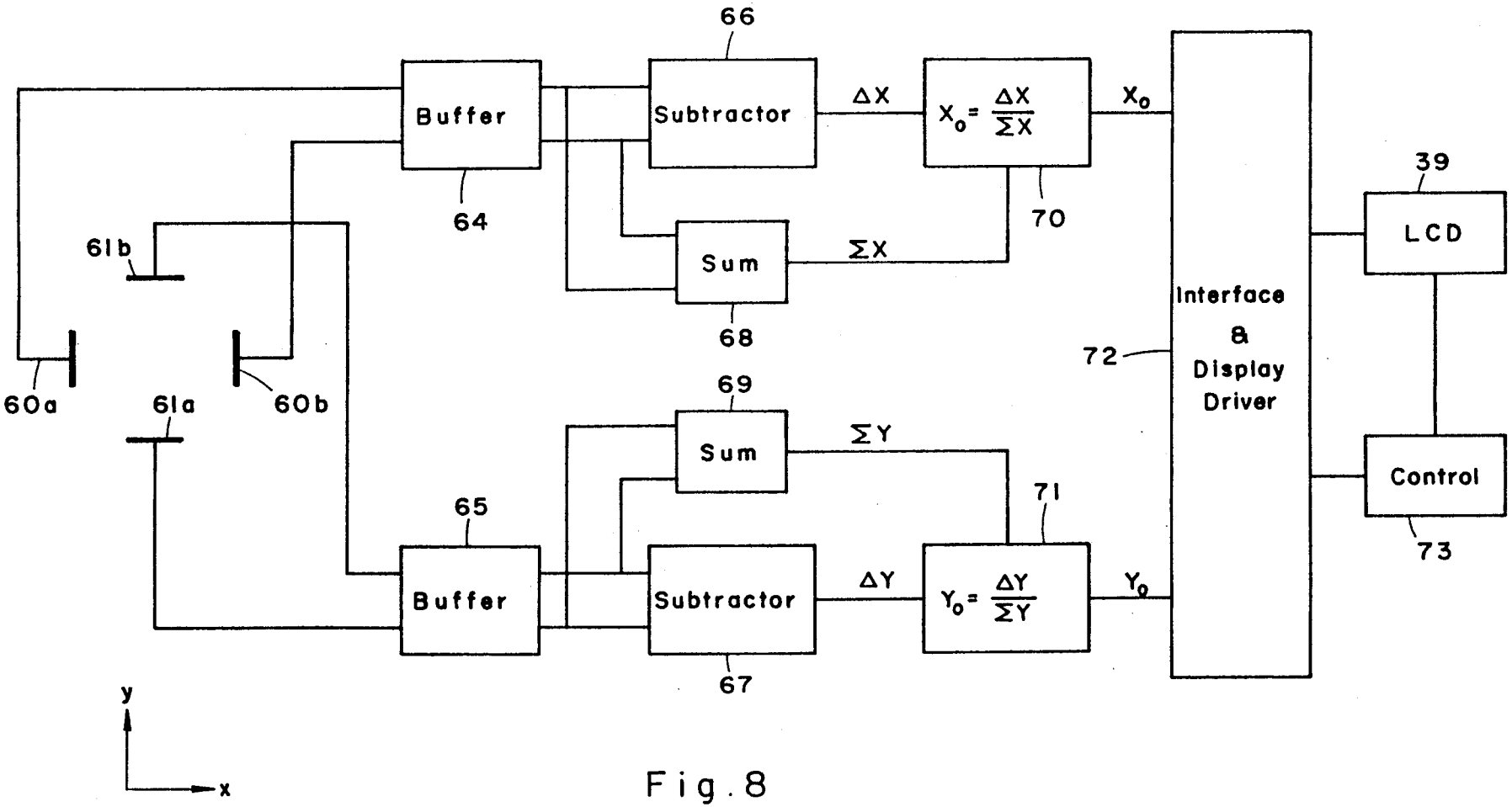
FIG. 8 is a block diagram showing schematically a sensor analyzer for use in the system illustrated in FIG. 1.

FIG. 8 is a block diagram showing functionally the principal elements of a circuit associated with the sensor 25 for relaying the output thereof to the LCD display 39 shown in FIG. 6. The sensor 25 has two pairs of outputs 60*a*, 60*b* and 61*a*, 61*b* such that a voltage is produced at each of the outputs corresponding to the position on the sensor 25 of the light spot image. Thus, assuming a Cartesian frame x-y as shown, the difference between the voltage magnitudes of the respective signals appearing at the outputs 60*a* and 60*b* corresponds to the horizontal displacement of the image spot from the origin of the sensor 25. Similarly, the difference between the voltage magnitudes of the signals appearing at the outputs 61*a* and 61*b* corresponds to the vertical displacement of the image spot with respect to the origin.

Although the difference between the voltage magnitudes of the signals appearing at the outputs 60*a*, 60*b* and 61*a*, 61*b* changes according to the relative displacement from the origin of the image spot, the differences have to be normalized with respect to the sum of the signals appearing at the respective outputs 60*a*, 60*b* and 61*a*, 61*b*.

Thus, the respective pairs of signals appearing at the outputs 60*a*, 60*b* and 61*a*, 61*b* are fed to corresponding buffers 64 and 65 the respective outputs of which are fed to a corresponding subtractor 66 and 67 and also to a corresponding summing unit 68 and 69.

The output $\Delta X$ from the subtractor 66 and the output $\Sigma X$ of the summing unit 68 as well as the output $\Delta Y$ of the subtractor 67 and the output $\Sigma Y$ of the summing unit 69 are fed to respective normalizing units 70 and 71 which produce respective outputs $X_o$ and $Y_o$, such that:

$$X_o = \frac{\Delta X}{\Sigma X}$$

-continued and $$Y_o = \frac{\Delta Y}{\Sigma Y}.$$

The outputs $X_o$ and $Y_o$ are fed to an A/D interface and display driver unit 72 whose output is fed to a control unit 73 for controlling the LCD display 39. The function of the control unit 73 is to control the brightness, contrast and focus of the LCD display 39.

In the preferred embodiment the sensor 25 has a continuous photo-sensitive surface for producing a continuously variable output depending on where the reflected beam strikes the surface. In such a sensor, the signals appearing at the outputs 60*a*, 60*b* and 61*a*, 61*b* are analogue and the subsequent processing is therefore also analogue. Since the LCD display 39 is a digital display unit, the interface and display driver 72 must include an analog-to-digital interface for converting the analogue signals $X_o$ and $Y_o$ to equivalent digital signals.

However, it will be appreciated that the sensor 25 can equally well be constituted by a discrete photo-sensitive surface for producing a discretely variable output depending on where the reflected beam strikes the surface.

It will also be understood that, whilst in the preferred embodiment, the superimposing means include an LCD display, any system for projecting an image of the light spot on to the visor 11 such that the resulting image of the light spot seen by the marksman appears to originate from infinity may equally well be employed.

We claim:

1. A method for aiming a small caliber weapon at a target, comprising the steps of:

(a) directing a light beam from the weapon towards an area of the target so as to form a light spot on an object in the target area, (b) imaging the light spot on a single two-dimensional position sensitive detector so as to form an image thereon whose displacement in two directions normal to each other from an origin of the detector bears a predetermined relationship to corresponding displacements of said object in said two directions from a center of the target, (c) projecting the image of the light spot on to a visor worn by a marksman and having a reference mark thereon for visually determining the center of the target, and (d) repeating steps (a), (b) and (c) as required until the projected image of the light spot on the visor is coincident with the reference mark.

2. A system for aiming a small caliber weapon at a target, the system comprising:

a light source fixed to the weapon for directing a beam of light in a direction substantially parallel to a barrel of the weapon so as to be reflected by an object in an area of the target as a reflected beam, a visor worn by a marksman and having a reference mark thereon for determining a line of sight along which the weapon must be aimed, a single two dimensional position sensitive sensor means mounted in a fixed relationship relative to the visor for receiving the reflected beam and producing an image thereof, and superimposing means for superimposing the image on to the visor such that the superimposed image lies on said line of sight when the weapon is aimed towards a center of the target.

3. The system according to claim 2, wherein the sensor means is so adjusted that the image is formed at a predetermined origin when the weapon is aimed towards the center of the target and is offset from said origin when the weapon is aimed off target.

4. The system according to claim 3, wherein the sensor means has a continuous photo-sensitive surface for producing a continuously variable output depending on where the reflected beam strikes said surface.

5. The system according to claim 3, wherein the sensor means has a discrete photo-sensitive surface for producing a discretely variable output depending on where the reflected beam strikes said surface.

6. The system according to claim 3, wherein:

the visor is provided with a reference mark for aligning with the center of the target, and the superimposing means is calibrated such that said origin is superimposed on the reference mark.

7. The system according to claim 2, wherein the superimposing means includes:

a two-dimensional light emitting array having a plurality of pixels, and optical means for directing an image of the of the pixels on to the visor via substantially parallel rays of light so that the superimposed image appears to originate from infinity; and the sensor is coupled to the light emitting array for illuminating one of said pixels.

8. The system according to claim 7, wherein:

the light emitting array includes a liquid crystal display, and the sensor is a two-dimensional position sensitive device for producing two signals at respective outputs thereof proportional to the relative horizontal and vertical displacements of the image from the origin.

9. The system according to claim 2, wherein said light source is a laser.

10. The system according to claim 9, wherein the light beam directed by said laser is invisible.

11. The system according to claim 2, wherein the sensor is mounted on the visor.

12. A system for aiming a small caliber weapon at a target, the system comprising:

a laser fixed to the weapon for directing a beam of light in a direction substantially parallel to a barrel of the weapon to the target so that said beam of light is reflected by an object in an area of the target as a reflected beam;

a visor worn by a marksman and having a reference mark thereon for determining a line of sight along which the weapon must be aimed, a single two dimensional position sensitive sensor means mounted in a fixed relationship relative to the visor for receiving the reflected beam and producing an image thereof, said laser and said sensor means operating in the same invisible range of spectrum; and superimposing means for superimposing the image on to the visor such that the superimposed image lies on said line of sight when the weapon is aimed towards a center of the target.

* * * * *